United States Patent [19]

Kuklies et al.

[11] Patent Number: 5,074,674

[45] Date of Patent: Dec. 24, 1991

[54] THERMOPLASTIC BAG

[75] Inventors: Milton C. Kuklies, Cleburne; William C. Seanor, Plano, both of Tex.

[73] Assignee: Vanguard Plastic, Inc., Addison, Tex.

[21] Appl. No.: 623,290

[22] Filed: Dec. 6, 1990

[51] Int. Cl.[5] ..... B65O 33/14

[52] U.S. Cl. ..... 383/8; 206/554; 383/9

[58] Field of Search ..... 383/8, 9; 206/554

[56] References Cited

U.S. PATENT DOCUMENTS

| | | | |
|---|---|---|---|
| Re. 33,264 | 7/1990 | Baxley et al. | 206/554 |
| 94,283 | 8/1969 | Collins . | |
| 2,302,855 | 11/1942 | Hallman | 164/28 |
| 2,715,493 | 12/1948 | Vogt | 229/69 |
| 2,790,591 | 4/1954 | Rosen | 229/53 |
| 2,899,161 | 8/1959 | Bayard | 248/101 |
| 3,089,633 | 4/1961 | Renshaw | 229/38 |
| 3,184,055 | 5/1965 | Davis | 206/57 |
| 3,243,937 | 4/1965 | Ragan | 53/384 |
| 3,262,249 | 5/1965 | Finerow | 53/385 |
| 3,298,416 | 10/1965 | Grady | 150/12 |
| 3,317,037 | 5/1965 | Russell | 206/57 |
| 3,352,411 | 10/1966 | Schwarzkopf | 206/57 |
| 3,358,904 | 10/1966 | Van Houtte | 229/54 |
| 3,380,579 | 6/1967 | Pinto | 206/57 |
| 3,439,891 | 6/1967 | Pinto | 248/100 |
| 3,468,100 | 9/1967 | Rubel | 53/189 |
| 3,552,697 | 1/1971 | Pinto | 248/97 |
| 3,640,450 | 2/1972 | Lieberman | 229/53 |
| 3,646,723 | 3/1972 | Meroney | 53/390 |
| 3,747,298 | 7/1973 | Lieberman | 53/390 |
| 3,869,065 | 3/1975 | Wang | 221/40 |
| 3,915,302 | 10/1975 | Farrelly et al. | 206/460 |
| 3,967,775 | 7/1976 | Kramming | 229/54 R |
| 3,973,376 | 8/1976 | Suominen | 53/385 |
| 4,044,890 | 8/1977 | Kramming | 206/493 |
| 4,062,170 | 12/1977 | Orem | 53/390 |
| 4,085,822 | 4/1978 | Osborn | 186/1 |
| 4,106,733 | 8/1978 | Walitalo | 248/100 |
| 4,106,734 | 8/1978 | Walitalo | 248/100 |
| 4,111,297 | 9/1978 | Paulin | 206/44.12 |
| 4,165,832 | 8/1979 | Kuklies et al. | 229/54 |
| 4,199,122 | 4/1980 | Christie | 248/97 |
| 4,268,346 | 5/1981 | Achelpohl | 156/510 |
| 4,458,867 | 7/1984 | Malik | 248/97 |
| 4,462,538 | 7/1984 | Gendron | 229/68 R |
| 4,480,750 | 11/1984 | Dancy | 206/554 |
| 4,487,388 | 12/1984 | Provan | 248/97 |
| 4,493,419 | 1/1985 | Prader et al. | 206/554 |
| 4,529,090 | 7/1985 | Pilon | 206/554 |
| 4,562,925 | 1/1986 | Pistner | 206/554 |
| 4,583,349 | 4/1986 | Kramming | 53/459 |
| 4,676,378 | 6/1987 | Baxley et al. | 383/9 |
| 4,785,938 | 11/1988 | Benoit, Jr. et al. | 383/8 |
| 4,811,417 | 3/1989 | Prince et al. | 383/8 |
| 4,819,806 | 4/1989 | Pistner | 206/554 |
| 4,877,806 | 10/1989 | Snowdon et al. | 156/204 |
| 4,909,636 | 3/1990 | DeMatteis et al. | 383/8 |

FOREIGN PATENT DOCUMENTS

| | | |
|---|---|---|
| 43450/72 | 6/1972 | Australia . |
| 75379 | 7/1978 | Australia . |
| 76160 | 10/1978 | Australia . |
| 77583 | 4/1979 | Australia . |
| 48197/79 | 6/1979 | Australia . |
| 62353/80 | 9/1980 | Australia . |
| 79465/82 | 1/1982 | Australia . |
| 1069455 | 1/1980 | Canada . |
| 108447 | 11/1965 | Denmark . |
| 2336906 | 8/1973 | Fed. Rep. of Germany . |
| 2442715 | 9/1974 | Fed. Rep. of Germany . |
| 2803961 | 1/1978 | Fed. Rep. of Germany . |
| 1486210 | 1/1966 | France . |
| 2602490 | 8/1986 | France . |

*Primary Examiner*—Gary E. Elkins

*Attorney, Agent, or Firm*—Ross, Howison, Clapp & Korn

[57] ABSTRACT

A bag mountable on laterally spaced support rods and a retainer disposed between the laterally spaced support rods of a support rack includes a front and a rear wall defining an open top. A pair of laterally spaced handles project upwardly from the open top of the bag. The handles include mounting apertures for the mounting of each handle on a corresponding support rod. The rear wall of the bag includes an aperture centrally disposed between the handles and below the open top for reception by the retainer for supporting only the rear wall of the bag on the rack.

6 Claims, 2 Drawing Sheets

THERMOPLASTIC BAG

TECHNICAL FIELD OF THE INVENTION

This invention relates to thermoplastic bag structures, and more particularly to a thermoplastic bag that is rack mounted and is easily opened and loaded while on the rack, and subsequently removed therefrom.

BACKGROUND OF THE INVENTION

Bags of the present invention are commonly referred to as T-shirt or handle bags, normally formed of a thin, highly flexible thermoplastic material. Such bags are frequently formed from flattened tube portions selectively severed from a length of tubing of appropriate material and subsequently heat sealed along the lower and upper edges thereof. An appropriate mouth cutout is normally made through the sealed upper edge of the tube which thereby defines both the upper mouth of the bag and a pair of laterally spaced handles. Such bags may be formed both with or without side gussets.

It has become common to provide such bags in packs for suspension on racks with the individual bags separately removeable therefrom. Bags have typically included apertured tear-off tabs with a rack support element received through the apertured tabs and with the entire tab being severed from the bag as the bag is removed from the rack after loading. Further, the racks include support structure received by apertures in the bag handles for supporting the bag both before and during loading. In order to open the bag for loading, the apertured tab must be severed from the front wall of the bag rack in order to open the mouth of the bag. This step in the loading process is time consuming. Further, once severed from the bags, the tabs of the bags require disposal.

A need has thus arisen for improved thermoplastic bags for providing easy and quick opening of a bag held on a rack for loading.

SUMMARY OF THE INVENTION

In accordance with the present invention, a bag mountable on laterally spaced support rods and a retainer disposed between the laterally spaced support rods of a support rack is provided. The bag includes a front and a rear wall defining an open top. A pair of laterally spaced handles project upwardly from the open top of the bag. The handles include mounting apertures for the mounting of each handle on a corresponding support rod. The rear wall of the bag includes an aperture centrally disposed between the handles and below the open top for reception by the retainer for supporting only the rear wall of the bag on the rack.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 2:
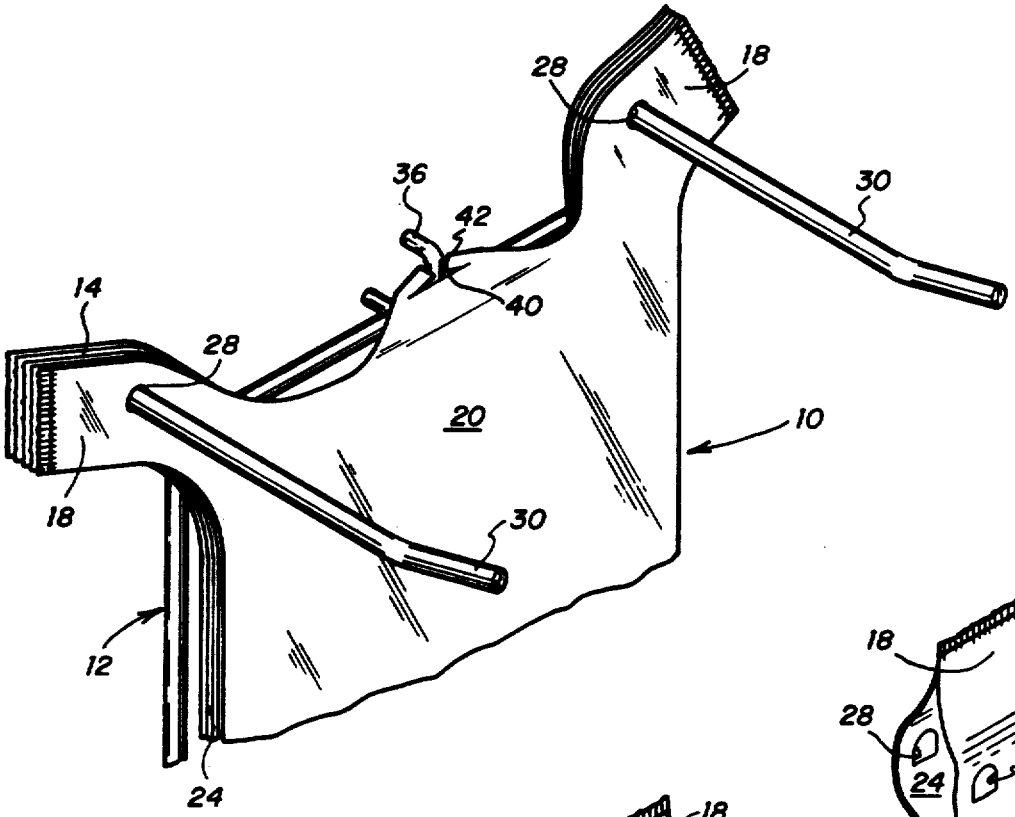
FIG. 2 is a partial perspective view of the bag of FIG. 1 mounted on a rack.
Figure 1:
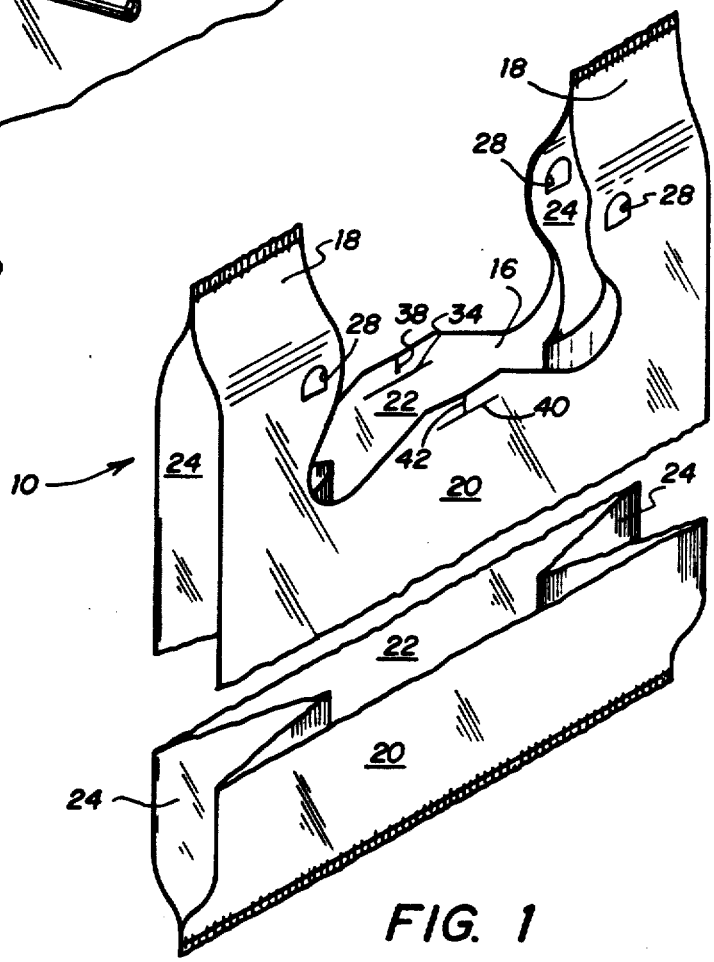
FIG. 1 is a partial perspective view of a bag in accordance with the present invention.

Referring simultaneously to FIGS. 1 and 2, the first embodiment of the bag of the present invention is illustrated, and is generally identified by the numeral 10. Bag 10 is mountable to a rack, generally identified by the numeral 12, and may be formed in a bag pack 14 composed of multiple individual bags 10.

Bag 10 is preferably a lightweight, flexible and strong thermoplastic material, and is conventionally fabricated from a continuous plastic tube gusseted, flattened and heat sealed at opposed upper and lower ends. Bag 10 includes a mouth or open top 16 which is formed by a cutout inwardly and centrally through the upper portion of bag 10. The cutout defines a pair of laterally spaced upwardly extending handles 18 formed of upwardly extending portions of a front wall 20 and a rear wall 22 of bag 10 as well as similarly upwardly extending portions of side gussets 24.

Handles 18 include apertures 28 which are received by support rods 30 of rack 12. Support rods 30 are laterally spaced and function to retain bags 10 and bag pack 14 on rack 12 prior to and during loading.

In accordance with the present invention, bag 10 is further retained on rack 12 through the use of an aperture 34. Aperture 34 is disposed centrally between handles 18 and below mouth 16 of bag 10. A retainer 36 mounted to rack 12 is received within aperture 34 for supporting bag 10 in the area between handles 18. This support is provided only to the rear wall 22 of bag 10. In order to remove bag 10 from rack 12 and specifically from retainer 36, rear wall 22 is severed by pulling bag 10 from rack 12. A preferential tear area may be provided adjacent to aperture 34, such as, for example, a preperforated line 38; however, a tear area is not required for the removal of rear wall 22 of bag 10 from rack 12.

In the fabrication of bag 10, front wall 20 of bag 10 includes an aperture 40 aligned with aperture 34 and a line 42. Line 42 is precut to intersect aperture 40 and therefore front wall 20 of bag 10 is not retained by retainer 36 when bag 10 is mounted to rack 12. In this manner, front wall 20 is free from rack 12 enabling bag 10 to be easily opened for loading purposes, as there is no portion of front wall 20 requiring detachment or severance from any portion of rack 12. In this manner, bag 10 can be easily and quickly opened for loading purposes while supported on rack 12. Rear wall 22 of bag 10 is severed from rack 12 after loading of bag 10, and bag 10 is removed from support rods 30 of rack 12.

Figure 4:
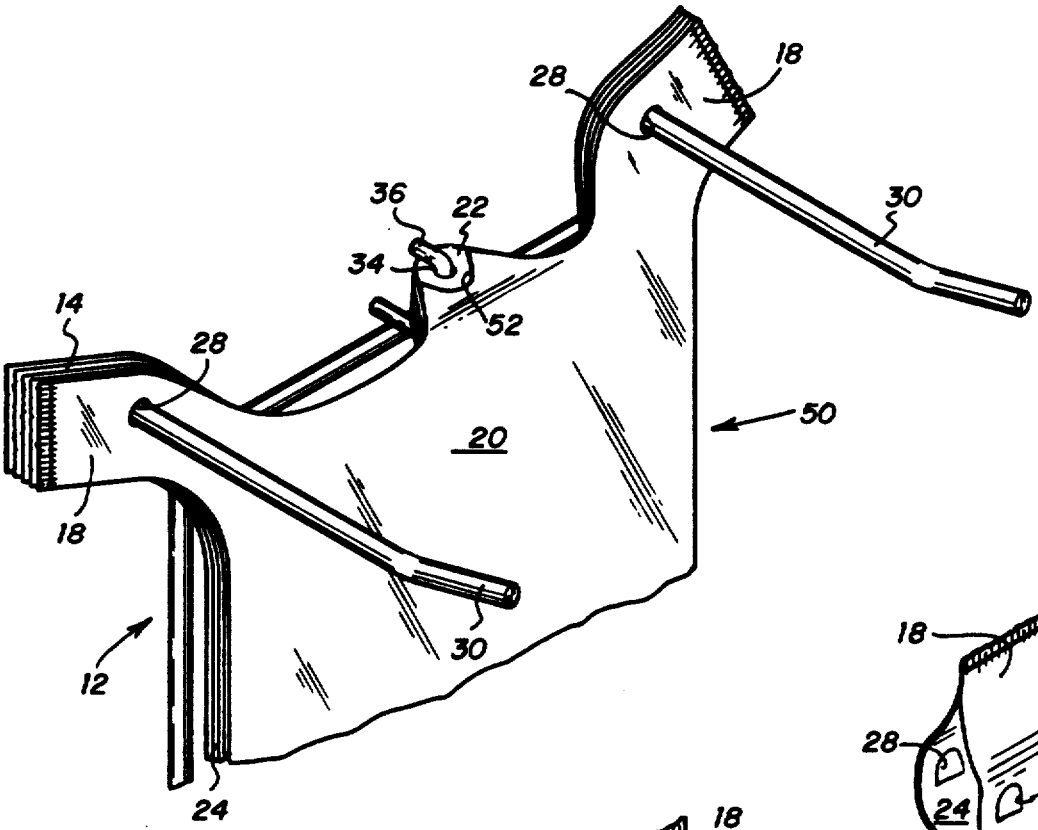
FIG. 4 is a partial perspective view of the bag of FIG. 3 mounted on a rack.
Figure 3:
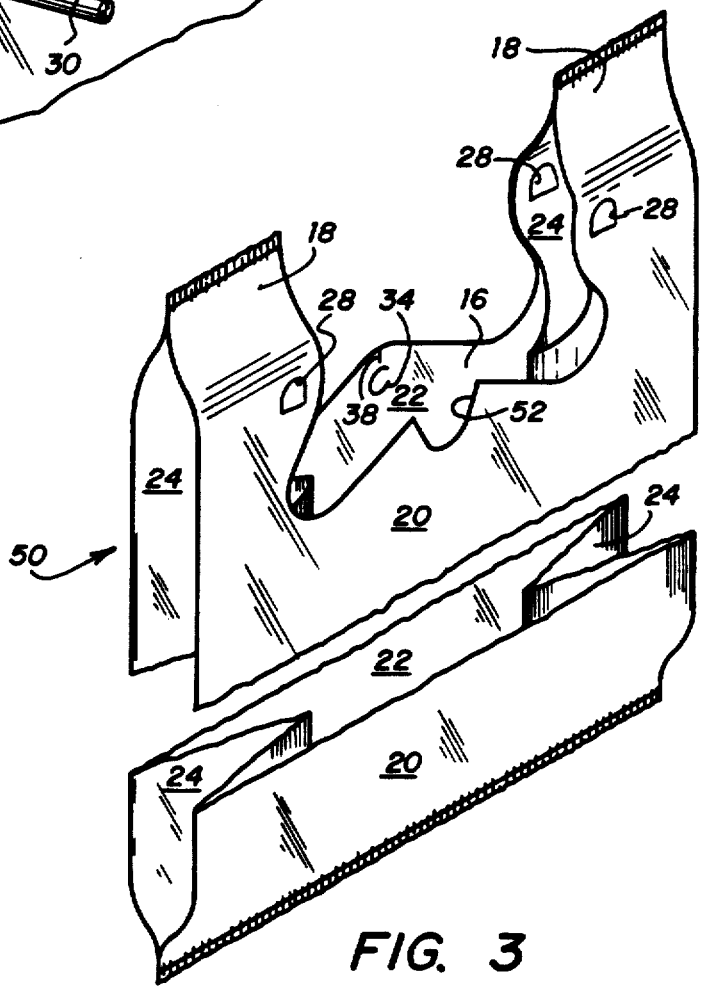
FIG. 3 is a partial perspective view of a second embodiment of the present invention.

Referring simultaneously to FIGS. 3 and 4, a bag 50 is illustrated in accordance with another embodiment of the present invention. Like numerals are utilized for like and corresponding components in FIGS. 3 and 4 as previously identified with respect to FIGS. 1 and 2. Bag 50 includes a notch 52 formed in front wall 20 of bag 50 in order to provide an area between handles 18 which can be easily grasped for opening bag 50 while bag 50 is supported on rack 12. Rear wall 22 of bag 50 is supported and severed from retainer 36 in a manner as described with respect to bag 10.

It therefore can be seen that the present invention provides for a bag and bag-rack combination in which bags are easily mountable to a rack and can be opened for loading in an easy and quick manner.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A bag mountable on laterally spaced support rods and a retainer disposed between the laterally spaced support rods of a support rack, the bag comprising:

front and rear bag walls each bag wall having a top edge;

a pair of laterally spaced handles projecting upwardly from said bag walls, said handles including mounting apertures for mounting each handle on a corresponding support rod; and said rear bag wall including an aperture centrally disposed between said handles and below said rear bag wall top edge for reception by the retainer for supporting only said rear bag wall of the bag said front bag wall being unsupported by the retainer and said bag rear bag wall being completely removable from the retainer when the bag is severed from the retainer.

2. The bag of claim 1 wherein said rear wall includes a severable area adjacent said rear wall aperture for severing said bag rear wall from the retainer.

3. The bag of claim 1 wherein said front bag wall includes a notch centrally disposed between said handles and extending below said front bag wall top edge to provide an area not supported by the retainer.

4. A system for mounting a pack of thermoplastic bags of the T-shirt type on a rack for supporting consecutive bags from the pack on the rack in an open loading position and for facilitating easy removal of the consecutive loaded bags from the rack, the system comprising:

a bag pack comprising a plurality of stacked T-shirt type bags, each of said bags comprising:

front and rear bag walls each bag wall having a top edge;

a pair of laterally spaced handles projecting upwardly from said bag walls, said handles including mounting apertures;

said rear bag wall including an aperture centrally disposed between said handles and below said rear bag wall top edge;

a rack comprising:

a pair of laterally spaced support rods for slidably receiving said apertures in said bag handles, for supporting consecutive ones of said bags in an open loading position as said bags are consecutively removed from said pack and slid along said support rods and for facilitating removal of loaded bags by sliding said handles off said support rods; and retaining means disposed between said laterally spaced support rods for receiving said aperture in said bag rear wall for mounting said bag rear wall to said rack and for allowing detachment of said bag rear wall from said retaining means as said bags are slid outwardly along said support rods said bag front wall being unsupported by said retaining means and said bag rear wall being completely removable from said retaining means when the bag is removed from said rack.

5. The system of claim 4 wherein said rear wall of said bag includes a severable area adjacent said rear wall aperture for severing said rear wall from said retaining means.

6. The system of claim 4 wherein said bag front wall includes a notch centrally disposed between said handles and extending below said front wall top edge to provide an area not supported by said retaining means.

* * * * *